United States Patent [19]

Mohler

[11] Patent Number: 4,812,884

[45] Date of Patent: Mar. 14, 1989

[54] THREE-DIMENSIONAL DOUBLE AIR GAP HIGH SPEED SOLENOID

[75] Inventor: David B. Mohler, Tipp City, Ohio

[73] Assignee: Ledex Inc., Vandalia, Ohio

[21] Appl. No.: 66,496

[22] Filed: Jun. 26, 1987

[51] Int. Cl.[4] ..... H01F 7/08

[52] U.S. Cl. ..... 335/258; 335/259; 335/261

[58] Field of Search ..... 335/251, 258, 259, 261, 335/264, 265, 267, 269, 279

[56] References Cited

U.S. PATENT DOCUMENTS

| | | | |
|---|---|---|---|
| 506,282 | 10/1893 | Timmis | 335/261 |
| 750,132 | 1/1904 | Timmis et al. . | |
| 2,424,776 | 7/1947 | Stapleton . | |
| 2,428,712 | 10/1947 | Kipke . | |
| 2,584,707 | 2/1952 | Jarvis et al. | 335/279 X |
| 3,157,831 | 11/1964 | Ray . | |
| 4,236,130 | 11/1980 | Hubert . | |
| 4,272,747 | 6/1981 | Bauer . | |
| 4,290,039 | 9/1981 | Tochizawa . | |
| 4,302,743 | 11/1981 | Araki . | |
| 4,327,345 | 4/1982 | Kelso et al. | 335/265 |
| 4,438,420 | 3/1984 | Leiber et al. | 335/261 X |
| 4,577,174 | 3/1986 | Lemmer | 335/279 X |
| 4,633,209 | 12/1986 | Belbel et al. | 335/279 X |

OTHER PUBLICATIONS

Electromagnetic Devices by Herbert C. Roters, New York-John Wiley & Sons, Inc., London: Chapman & Hall, Limited 1941.

*Primary Examiner*—George Harris

*Attorney, Agent, or Firm*—Nixon & Vanderhyde

[57] ABSTRACT

Disclosed is a solenoid having a central and a peripheral air gap between the armature and the pole piece. The energizating coil is located in the space between the central core and the peripheral portions of the pole piece and armature. In one embodiment, an output shaft is received in an aperture in the central core of the pole piece and connected to the armature. In preferred embodiments, a longitudinally and radially extending slot is provide to produced eddy current losses. Additionally, mass is removed from non-critical portions of the armature to reduce its weight and increase its acceleration during energization of the solenoid. By utilizing stepped changes in the pole piece and armatures, peripheral portions and central core portions as well as variations in the central and peripheral gaps, the force/-distance curve of the solenoid can be tailored to the specific application. In one embodiment, the armature comprises a central core which is moveable relative to the peripheral portion only in the operating direction. This permits a very small peripheral gap to generate high initial acceleration forces which are imparted to the armature central core but does not limit the central core to an inordinately short operating stroke.

6 Claims, 3 Drawing Sheets

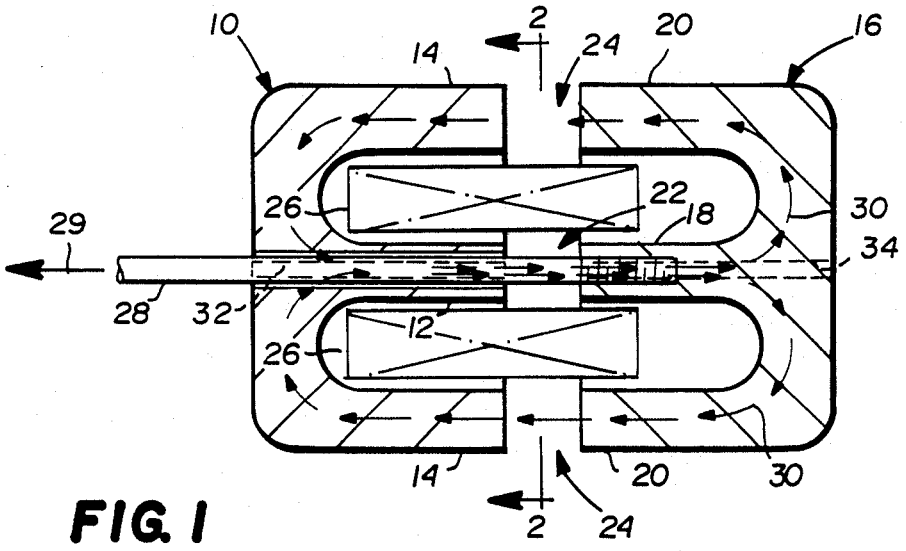
FIG. 1
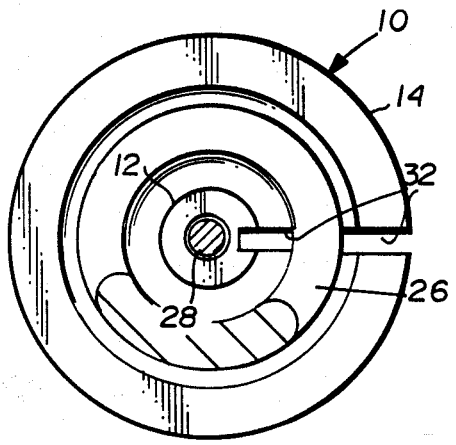
FIG. 2
FIG. 3
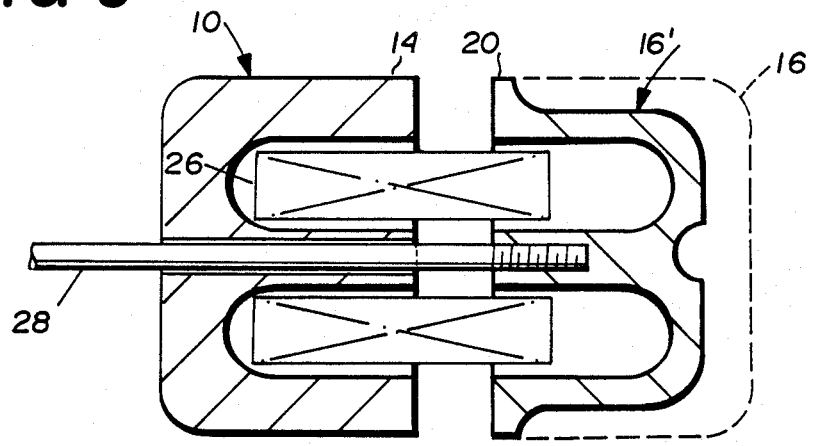

THREE-DIMENSIONAL DOUBLE AIR GAP HIGH SPEED SOLENOID

BACKGROUND OF THE INVENTION

The present invention relates generally to the field of solenoids and specifically to double air gap high speed solenoid improvements.

With the advent of electronic fuel injection, there has arisen a need for small, high speed, highly reliable solenoids capable of operating a valve controlling fuel flow into the individual cylinders of an internal combustion engine. Such a solenoid must open at the desired instant and remain open only long enough to allow the precise amount of fuel to be metered into the cylinder of the engine. If the solenoid is not extremely consistent in its operation, dramatic differences in engine fueling will result causing rough running and/or poor fuel economy.

In attempting to make a small, high speed solenoid, it is desirable to have a large coil so as to generate a large magnetic flux while at the same time minimizing the size of the coil to stay within a relatively small package. Further, the pole piece (the fixed core of the solenoid) and the armature (the moveable portion of the solenoid) are generally arranged so that the magnetic flux crosses one air gap between them in the direction of solenoid movement (the operating direction) which causes the attraction which operates the solenoid. The magnetic flux path then returns through a radial air gap which does not contribute to the attractive forces. The strength of the circulating loop of magnetic flux is determined by the coil size, current flow through the coil, magnetic permeability of the core pieces and the magnetic reluctance across the various air gaps. To a certain extent, the small size requirement of fuel injection solenoids works against the use of a large coil and/or a large core to develop large flux flows through the core.

In the interest of both volumetric efficiency and power efficiency a high speed solenoid must develop maximum force which can be shown to correspond to approximately 260 lbs. per square inch of steel area under saturated conditions. This degree of efficiency also is dependent upon minimizing flux fringing, that is, flux lines which do not pass through a working air gap, and upon eliminating the energy loss associated with driving flux through a non-working air gap.

In the past, two-dimensional double air gap solenoids have been utilized to provide an increased operating force in the operating direction without a corresponding increase in flux density. U.S. Pat. No. 3,157,831 issued to W. A. Ray on November 17, 1964 is an example of a two-dimensional double air gap solenoid. A circular coil is wound so as to provide a toroidal flux path. The pole piece of laminated plate construction has three legs, center leg 3 which extends into the coil and outer leg 2 and 4 which extend on the outer portion of the core. The armature 19 is also laminated and a center leg 23 extends into the coil 14 and outer legs 21 and 22 extend outside the core. Upon energization of the electromagnetic coil, the center legs of the core and armature attract each other as do the outer two legs of each structure. The air gaps between the legs of the armature and the legs of the pole piece extend in the operating direction of the solenoid such that attractive forces generated by the flux passing through an air gap are all in the desired operating direction. This is a distinct improvement over prior art solenoids which generally included a radial air gap in the return magnetic flux path. Such a radial air gap would also cause sideways forces on the armature increasing the wear of armature bushings and other components. Furthermore, this sideways attractive force is not in the desired operating direction and therefore is "wasted" as far as the solenoid operation is concerned.

Difficulties with the two-dimensional double air gap solenoids include the failure to maximize flux passage as a result of current flow in the coil in directions other than the two-dimensional plane. This failure results in a loss of efficiency. Additionally, although eddy current generation is minimized in two-dimensional solenoids by the use of laminated plates making up the armature and the core, the use of laminated cores does not lend itself to the construction of cylindrical, closed construction as is preferable for better volumetric efficiency and the exclusion of contaminating particles.

Also, one characteristic of many solenoids is that given a fixed operating current through the coil, the attractive force between the pole piece and the armature varies as the inverse exponential of the distance between the two. Consequently, if a high initial force is needed to accelerate the armature to a specific desired traveling speed, a short air gap is necessary. However, the use of a short air gap also limits the operating travel of the solenoid to a similar short distance. In some solenoids, complex lever arms and the like have been utilized in an attempt to obtain a longer stroke and yet still operate with the pole and armature spacing very small.

SUMMARY OF THE INVENTION

In accordance with the above disadvantages in the prior art, it is an object of the present invention to provide a three-dimensional double air gap solenoid suitable for high speed operation.

It is further object of the present invention to provide a three-dimensional double air gap solenoid which overcome problems of eddy current generation without the use of laminated cores.

Another object of the present invention is to increase the acceleration rate of the moveable armature without increasing the solenoid coil size or operating current.

It is a still further object of the present invention to be able to adjust the force versus distance curve to be other than an inverse exponential ratio.

It is an additional object of the present invention to be able to establish an extremely high initial acceleration of the armature but at the same time maintain a relatively long stroke of operation.

The above and other objects are achieved in accordance with the present invention by providing a three-dimensional central and outer armature and a three-dimensional central and outer pole piece in which magnetic flux flow is induced by the electromagnetic coil located therein. In a preferred embodiment, an output shaft is fixed to the armature and extends through an aperture in the central portion of the pole piece so as to guide movement of the armature. In one embodiment, both the pole piece and the armature have a longitudinal and radially extending slot which serves to reduce eddy current losses to an acceptable level. In another preferred embodiment, the armature is of a reduced thickness of permeable material in all regions except the immediate vicinity of the air gaps so as reduce its inertia but maintain the air gap generated attractive force. In a still further embodiment, the shape of the armature and pole piece in the vicinity of the air gaps is modified so as to change the force/distance ratio and thus modify the operating curve of the solenoid. A specifically preferred embodiment is one in which the periphery of the pole piece and armature have stepped configurations which saturate as they approach each other so as to prevent a further increase in attractive force as the distance closes.

The above and other objects are achieved in accordance with a still further object of the present invention in which a two piece armature is utilized. The outer periphery of the armature has a very small air gap with respect to the periphery of the pole piece and provides extremely high initial acceleration forces to the output shaft. The second part of the armature, the central core, is moveable with respect to the outer peripheral portion of the armature in the operating direction only but has a greater air gap between it and the pole piece core. After being accelerated by the outer armature, the inner armature continues closing its gap after the outer armature gap has already been closed, providing a long operating stroke combined with high initial acceleration.

BRIEF DESCRIPTION OF THE DRAWINGS

A more complete appreciation of the invention, and many of the attendant advantages thereof, will be readily apparent by reference to the accompanying drawings, wherein:

FIG. 1 is a side view, partially in section, showing one embodiment of the present invention;

FIG. 2 is a view of FIG. 1 along section lines 2—2;

FIG. 3 is a side view, partially in section, of a further embodiment of the present invention;

DETAILED DESCRIPTION OF PREFERRED EMBODIMENTS

Figure 4A:
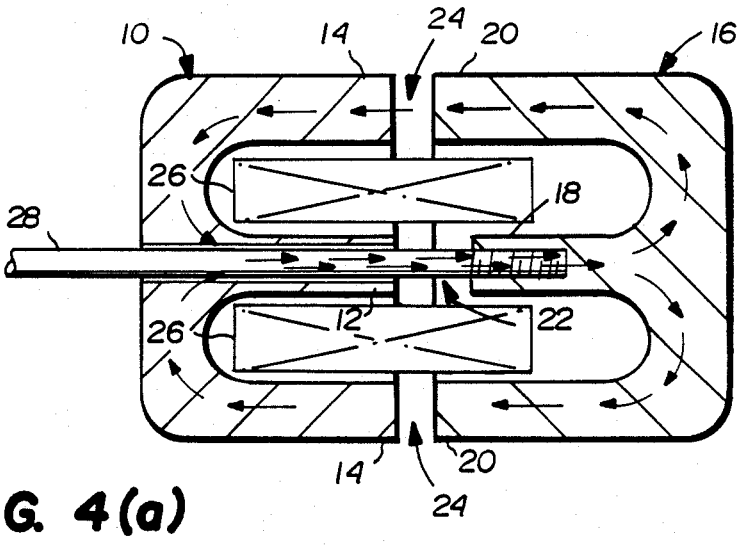
FIGS. 4(*a*) and 4(*b*) are side views, partially in section, of further embodiments of the present invention.

Referring now more particularly to the drawings, wherein like numerals represent like elements throughout the several views, FIG. 1 illustrates the magnetic flux path through applicant's three-dimensional double air gap solenoid. A pole piece 10 has a pole central core 12 and a pole peripheral portion 14. Armature 16 includes an armature central core 18 and armature peripheral portion 20. The pole central core 12 and armature central core 18 define a central gap 22 and similarly pole peripheral portion 14 and armature peripheral portion 20 define peripheral gap 24. Coil 26 is disposed in the space between the central core and the peripheral portions. In a preferred embodiment, an output shaft 28 is threadable connected to armature central core 18 and extends in the longitudinal operating direction (arrow 29) through a hole in pole central core 12. In some embodiments, it may be advantageous to utilize a sleeve bearing in the pole central core 12 to facilitate movement of output shaft 28.

Arrows 30 indicate the direction of induced magnetic flux flow through armature 16 and pole piece 10 during energization of coil 26. Although output shaft is shown relatively large compared to the central cores, it is generally a much smaller size or is comprised of a non-permeable material so that it does not significantly affect the resistance to flux flow (reluctance) across central gap 22. It can be seen that during energization of the coil the only two significant impediments to flux flow are across central gap 22 and peripheral gap 24. Therefore, strong attractive forces are developed between pole piece 10 and armature 16 at these regions. Because the peripheral portions of the pole and armature completely surround the coil 26, except in the vicinity of the peripheral gap, there will be no magnetic flux generated by the coil which is not used to generate an attractive force between the pole and armature.

FIG. 2 illustrates the circular nature of the preferred embodiment of FIG. 1. However, it should be noted that there is no requirement that the solenoid have a circular configuration. In order to enjoy the benefits of the present invention, it is only necessary that the peripheral portion of the pole piece and armature encompass coil 26 so as to provide a highly efficient use of the generated magnetic flux. Oval and rectangular configurations are envisioned as well. However, with a non-circular embodiment, it would be necessary to ensure that the armature did not rotate relative to the pole so as to maintain proximity at the peripheral gap. FIG. 2 more clearly illustrates pole slot 32 which extends longitudinally and radially on at least one side of pole piece 10. A similar armature slot 34 extends in armature 34. Both slots, shown in phantom lines 32 and 34 in FIG. 1, serve to effectively reduce eddy currents generated by magnetic flux flow through the pole and armature.

Although in a preferred embodiment the armature 16 is slideably mounted for movement relative to pole piece 10 by means of the output shaft 28, any other means for mounting the armature for slideable movement relative to the pole piece could be used. Additionally, different output shaft orientations could be utilized.

One modification of applicant's invention is illustrated in FIG. 3. In order to increase the acceleration of the armature when coil 26 is energized, the mass of the armature has been reduced by removing excess material. The original outline of the armature is shown in phantom lines 16 and the modified armature 16' is shown in solid lines. It should be noted that the pole piece 10 has not been modified since it and coil 26 are fixed in position during operation. The armature peripheral portion 20 has also been maintained in size transverse to the operating direction in order to maintain the attractive force levels between the armature and pole piece during energization. Also, as the armature moves toward the pole piece and the gap decreases the resistance to magnetic flux flow or reluctance of the electromagnetic flux circuit decreases and thus the flux density increases. The maintenance of a wide surface area in this region, relative to that of the adjacent cross-sectional area of the steel, serves to improve the rate of change of air gap permeance, dP/dS, and thus the actuation force which is given by $F=\mathcal{F}^2 dP/2dS$ for each air gap where $\mathcal{F}$ is the mmf in ampere-turns developed across each air gap. The consequence of flux saturation across the gap is that further decreases in gap width will not result in a further increase in attractive force. However, in the remainder of the armature peripheral flux flow path, the thickness of material can be significantly reduced so as to lighten the armature allowing it to accelerate at a higher rate during energization of the solenoid.

Figure 4B:
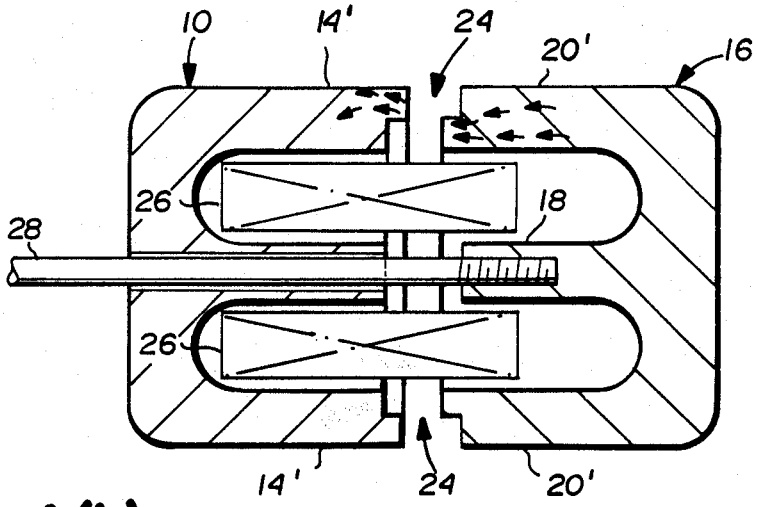

FIGS. 4(*a*) and 4(*b*) illustrate variations in the three-dimensional double air gap solenoid. In order to modify the force/distance curve, changes in the relationship of the pole to the armature, especially in the vicinity of the central gap 22 and peripheral gap 24, can be made. For example, in FIG. 4A, the peripheral gap 24 is much smaller than the central gap 22. Therefore, upon initial energization, the central gap will provide only a slight attractive force while the peripheral gap will provide a much greater attractive force. Reversal of this arrangement would provide the opposite result. This permits some "tailoring" of the solenoid design to fit the specific application.

FIG. 4(*b*) shows a further embodiment affecting the force/distance relationship during energization. When initially energized, the FIG. 4(*b*) embodiment will have attractive forces essentially equivalent to that shown in FIG. 1. However, due to the stepped nature of the peripheral portions and the fact that one (armature peripheral portion 20') will partially slide inside the other (pole peripheral portion 14') as overlap begins to occur, saturation of magnetic flux flow begins to occur preventing further increase of attractive forces (at least due to the peripheral portion) reducing the overall attractive force with respect to that which would occur at a similar gap in the FIG. 1 embodiment. In FIG. 4(*b*), of course, the central cores have not been modified and thus these would continue to provide an increasing attractive force as the central gap decreased. Thus, it can be seen that by judiciously choosing of the stepped relationship in the peripheral portions and central cores of the pole and armature, the force/distance curve can be tailored to the specific requirements of the solenoid application.

Figure 5A:
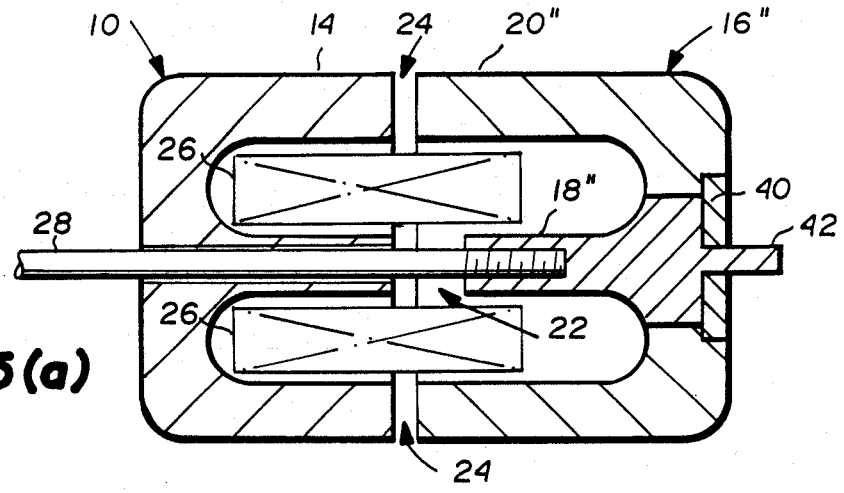
FIGS. 5(*a*), 5(*b*) and 5(*c*) are side views, partially in section, of the operating sequence of a further preferred embodiment of applicant's invention.
Figure 5B:
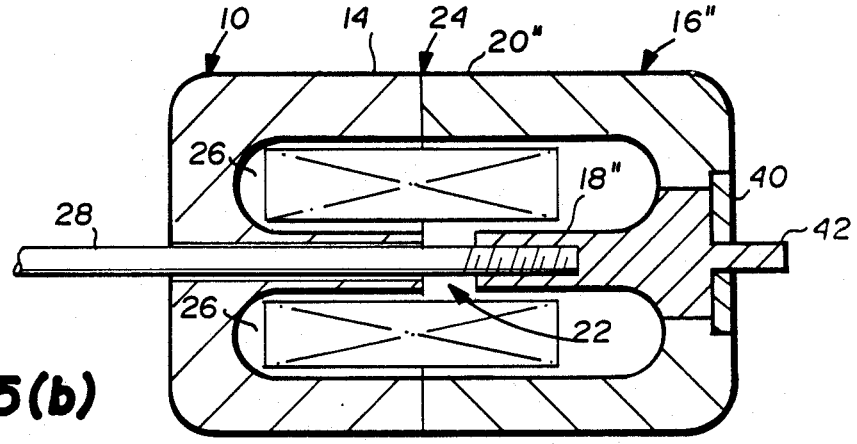
Figure 5C:
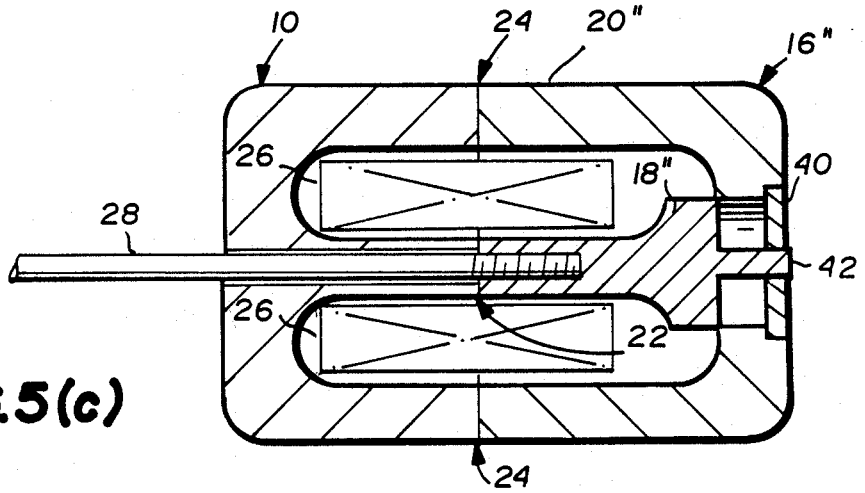

FIGS. 5(*a*), 5(*b*) and 5(*c*) show a further embodiment of the present invention which provides for extremely high initial acceleration coupled with a relatively long operating stroke. In FIG. 5(*a*), a two piece armature 16'' is shown which includes armature central core 18'' which is moveable in and with respect to armature peripheral portion 20''. A step portion 40 of the armature 16'' prevents the armature central core 18'' from moving to the right relative to armature peripheral portion 20''. However, armature central core 18'' is free to move in the operating direction with respect to armature peripheral portion 20''. The operation of this embodiment is illustrated in FIGS. 5(*a*) through 5(*c*).

Upon energization of coil 26, extremely high attractive forces are generated by the very narrow peripheral gap 24. This causes a high acceleration of the entire armature assembly towards the pole piece 10 including central core 18'' and output shaft 28 due to step 40. This acceleration increases because the attractive forces increase further as the gap 24 decreases. Only when the gap has decreased to zero as shown in FIG. 5(*b*) does the armature peripheral portion 20'' stop accelerating towards the pole piece 10. However, the armature central core 18'' and output shaft 28 are free to continue moving in the operating direction with respect to the peripheral portion 20'' because a substantial central gap 22 still remains. Since the peripheral gap 24 is closed, the reluctance to magnetic flux flow across this gap is minimized allowing magnetic flux flow to increase across the central gap 22. Therefore, the attractive forces on the armature central core 18'' increase and continue moving the output shaft 28 to the left until the gap 22 is closed as shown in FIG. 5(*c*). The distance between stepped portion 40 of the armature central core and the end of moveable armature central core 18'' is an indication of the additional distance that the core has moved relative to the peripheral portion 20''. Although the internal configuration of the sliding surfaces is not critical, a guide member 42 is shown extending through an aperture in the peripheral portion 20'' so as to guide the central core 18'' during its return movement.

Many modifications of the FIG. 5(*a*) embodiment will be apparent. With an operating shaft attached to the peripheral portion 20'', it would be more desirable to have a peripheral gap 24 which is larger than central gap 22. Furthermore, the stepped portion 40 would be reconfigured so that the peripheral portion could continue to move in the operating direction after the central core gap 22 had closed. Although slideable connections have been shown between the core 18'' and peripheral portion 20'', many other modifications and embodiments would be obvious to those of ordinary skill such as elastomeric interconnections, flexible beam connections, etc.

The benefits of the three-dimensional double air gap solenoid will be readily apparent to those of ordinary skill in the solenoid art in view of the above description. Many variations and modifications of this solenoid above and beyond those disclosed in the above discussion will also be readily apparent. For example, many permeable materials can be utilized for the pole piece 10 and the armature 16 in each of the preferred embodiments. It may be desirable in some circumstances to use a plurality of slots as disclosed in FIG. 2. It may also be desirable to combine several of the embodiments shown in the various Figures. For example, the slot utilized in FIG. 2 to reduce eddy currents could also be used advantageously in any other embodiment for the same purpose. Similarly the mass (and therefore inertia) reduction described in FIG. 3 could also be applied to the FIG. 4 or FIG. 5 embodiments. Further, the stepped configuration of the peripheral portion disclosed in FIG. 4(*b*) could be applied to either the central core and/or peripheral portion in FIGS. 3 and 5. Therefore, in view of the numerous modifications and variations of applicant's invention, the scope of this invention is limited only by the following claims appended hereto.

What is claimed is:

1. A three-dimensional double air gap solenoid, comprising:

a pole piece of magnetically permeable material including a pole central core protruding from a central region of said pole piece in a given direction and a pole peripheral portion protruding from a peripheral region of said pole piece in said direction;

an armature of magnetically permeable material including an armature central core protruding from a central region of said armature towards said pole central core and an armature peripheral portion protruding from a peripheral region of said armature towards said pole peripheral portion;

coil means, fixed relative to said pole piece, for producing a magnetic field, said coil means including means defining an opening therein, at least one of said pole central core and said armature central core at least partially located in said opening and said pole peripheral portion and said armature peripheral portion forming a sleeve at least partially surrounding said coil means;

said pole central core and said armature central core being substantially axially aligned with one another and spaced apart forming a central gap and said pole peripheral portion and said armature peripheral portion being substantially axially aligned with one another and spaced apart forming a peripheral gap, said central gap and said peripheral gap existing at least during de-energization of said solenoid;

means for permitting said armature to move relative to said pole piece in an operating direction so as to decrease said central gap and said peripheral gap; and means for slideably mounting said armature central core in said armature peripheral portion, for movement in said operating direction and means for preventing movement of said armature central core with respect to said armature peripheral portion in a direction opposite said operating direction.

2. The solenoid according to claim 1, wherein said preventing means comprises a step in said slideable mounting means and said central gap is greater than said peripheral gap.

3. A three-dimensional double air gap solenoid, comprising:

a pole piece of magnetically permeable material including a pole peripheral portion protruding in a given direction from a peripheral region of said pole piece;

an armature of magnetically permeable material including an armature peripheral portion protruding towards said pole peripheral portion from a peripheral region of said armature;

coil means, fixed relative to said pole piece, for producing a magnetic filed, said coil means including means defining an opening therein and said pole peripheral portion and said armature peripheral portion forming a sleeve at least partially surrounding said coil means;

said pole peripheral portion and said armature peripheral portion being substantially axially aligned with one another and spaced apart forming a peripheral gap, said peripheral gap existing at least during de-energization of said solenoid; and means for permitting said armature to move relative to said pole piece in a operating direction opposite to said given direction so as to decrease said peripheral gap;

wherein at least one of said pole piece and said armature includes means for reducing eddy current losses wherein said means for reducing eddy current losses comprises a slot in at least one of said armature and said pole piece, said slot extending in said operating direction and also extending radially in said operating direction and also extending radially outward from a center of said pole and armature.

4. A three-dimensional double air gap solenoid, comprising:

a pole piece of magnetically permeable material including a pole peripheral portion protruding in a given direction from a peripheral region of said pole piece;

an armature of magnetically permeable material including an armature peripheral portion protruding towards said pole peripheral portion from a peripheral region of said armature;

coil means, fixed relative to said pole piece, for producing a magnetic field, said coil means including means defining an opening therein and said pole peripheral portion and said armature peripheral portion forming a sleeve at least partially surrounding said coil means;

said pole peripheral portion and said armature peripheral portion being substantially axially aligned with one another and spaced apart forming a peripheral gap, said peripheral gap existing at least during de-energization of said solenoid; and means for permitting said armature to move relative to said pole piece in an operating direction opposite to said given direction so as to decrease said peripheral gap;

wherein said pole piece comprises a given mass and said pole peripheral portion in the vicinity of said peripheral gap has a width in a direction transverse to said operating direction and said armature has a mass substantially less than said give mass and said armature peripheral portion adjacent said peripheral gap has a width substantially similar to said pole piece width which is greater than an armature thickness elsewhere in said armature.

5. The solenoid according to claim 3 wherein said pole piece includes a pole central core protruding from a central region from said pole piece in said given direction; said armature includes an armature central core protruding from a central region of said armature towards said pole central core, at least one of said pole central core and said armature central core at least partially located in said coil means opening, said pole central core and said armature central core being substantially axially aligned with one another and spaced apart forming a central gap, said central gap existing at least during de-energization of said solenoid.

6. The solenoid according to claim 4 wherein said pole piece includes a pole central core protruding from a central region from said pole piece in said given direction; said armature includes an armature central core protruding from a central region of said armature towards said pole central core, at least one of said pole central core and said armature central core at least partially located in said coil means opening, said pole central core and said armature central core being substantially axially aligned with one another and spaced apart forming a central gap, said central gap existing at least during de-energization of said solenoid.

* * * * *